US009659696B2

(12) United States Patent
Loginov et al.

(10) Patent No.: US 9,659,696 B2
(45) Date of Patent: May 23, 2017

(54) PERMANENT MAGNET ASSEMBLIES FOR GENERATING CONCAVE FIELD LINES AND PROCESS FOR CREATING OPTICAL EFFECT COATING THEREWITH (INVERSE ROLLING BAR)

(71) Applicant: SICPA HOLDING SA, Prilly (CH)

(72) Inventors: Evgeny Loginov, Renens (CH); Mathieu Schmid, Lausanne (CH); Claude Alain Despland, Prilly (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 14/898,007

(22) PCT Filed: Jun. 13, 2014

(86) PCT No.: PCT/EP2014/062397
§ 371 (c)(1),
(2) Date: Dec. 11, 2015

(87) PCT Pub. No.: WO2014/198905
PCT Pub. Date: Dec. 18, 2014

(65) Prior Publication Data

US 2016/0133369 A1 May 12, 2016

(30) Foreign Application Priority Data

Jun. 14, 2013 (EP) ..... 13172078

(51) Int. Cl.
*B05D 5/06* (2006.01)
*H01F 7/02* (2006.01)
(Continued)

(52) U.S. Cl.
CPC ..... *H01F 7/0278* (2013.01); *B05D 3/20* (2013.01); *B05D 5/06* (2013.01); *B05D 5/065* (2013.01); *B42D 15/00* (2013.01); *H01F 1/06* (2013.01)

(58) Field of Classification Search
CPC ..... B05D 5/06–5/068
See application file for complete search history.

(56) References Cited

U.S. PATENT DOCUMENTS 2,570,856 A 10/1951 Carlton
3,676,273 A 7/1972 Graves
(Continued)

FOREIGN PATENT DOCUMENTS

EP 0406667 1/1991
EP 0556449 8/1993
(Continued)

OTHER PUBLICATIONS

Adams et al., "Printing Technology", Delmar Thomson Learning, 5th Edition, pp. 1-3 (2002).
(Continued)

*Primary Examiner* — Ramon M Barrera
(74) *Attorney, Agent, or Firm* — Greenblum & Bernstein, P.L.C.

(57) ABSTRACT

The invention relates to the field of the protection of security documents such as for example banknotes and identity documents against counterfeit and illegal reproduction. In particular, the invention relates to magnetic-field-generating devices which produce positively curved magnetic field lines in a concave fashion. The invention also relates to the use of these magnetic-field-generating devices for producing optical effect layers OEL which exhibit the optical impres-
(Continued)

sion of a positive rolling bar effect and to processes using these magnetic-field-generating devices, e.g. in the field of document security.

8 Claims, 7 Drawing Sheets

(51) Int. Cl.

| | |
|---|---|
| ***B05D 3/00*** | (2006.01) |
| ***B42D 15/00*** | (2006.01) |
| ***H01F 1/06*** | (2006.01) |

(56) References Cited

U.S. PATENT DOCUMENTS

| | | | | |
|---|---|---|---|---|
| 3,791,864 | A | 2/1974 | Steingroever | |
| 4,838,648 | A | 6/1989 | Phillips et al. | |
| 5,364,689 | A | 11/1994 | Kashiwagi et al. | |
| 5,630,877 | A | 5/1997 | Kashiwagi et al. | |
| 5,663,701 | A * | 9/1997 | Kaura | B03C 1/28 335/306 |
| 6,531,221 | B1 | 3/2003 | Schumacher et al. | |
| 6,582,781 | B1 | 6/2003 | Schumacher et al. | |
| 6,838,166 | B2 | 1/2005 | Phillips et al. | |
| 2004/0051297 | A1 | 3/2004 | Raksha et al. | |
| 2005/0106367 | A1 | 5/2005 | Raksha et al. | |
| 2010/0040845 | A1 | 2/2010 | Schmid et al. | |
| 2012/0055355 | A1 | 3/2012 | Li et al. | |

FOREIGN PATENT DOCUMENTS

| | | |
|---|---|---|
| EP | 686675 | 12/1995 |
| EP | 1710756 | 10/2006 |
| EP | 1641624 | 4/2008 |
| EP | 1937415 | 4/2009 |
| WO | WO02/073250 | 9/2002 |
| WO | WO02/90002 | 11/2002 |
| WO | WO03/000801 | 1/2003 |
| WO | WO2005/002866 | 1/2005 |
| WO | WO2006/063926 | 6/2006 |
| WO | WO2007/131833 | 11/2007 |
| WO | WO2008/046702 | 4/2008 |
| WO | WO2010/058026 | 5/2010 |
| WO | WO2010/066838 | 6/2010 |
| WO | WO2013/167425 | 11/2013 |

OTHER PUBLICATIONS

Crivello et al., "Chemistry & Technology of UV &EB Formulation for Coatings, Inks & Paints", John Wiley & Sons, published in 7 volumes in association with SITA Technology Limited, pp. 1-4 (1998).

* cited by examiner

PERMANENT MAGNET ASSEMBLIES FOR GENERATING CONCAVE FIELD LINES AND PROCESS FOR CREATING OPTICAL EFFECT COATING THEREWITH (INVERSE ROLLING BAR)

FIELD OF THE INVENTION

The present invention relates to the field of the protection of value documents and value commercial goods against counterfeit and illegal reproduction. In particular, the present invention relates to devices and processes for producing optical effect layers (OEL) showing a viewing-angle dependent optical effect, items carrying said OEL and uses of said optical effect layers as an anti-counterfeit means on documents.

BACKGROUND OF THE INVENTION

It is known in the art to use inks, compositions or layers containing oriented magnetic or magnetizable particles or pigment particles, particularly also magnetic optically variable pigment particles, for the production of security elements, e.g. in the field of security documents. Coatings or layers comprising oriented magnetic or magnetizable pigment particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g. for security documents, can generally be classified into "covert" security features one the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g. such features may be visible and/or detectable via the tactile senses while still being difficult to produce and/or to copy. However, the effectiveness of overt security features depends to a great extent on their easy recognition as a security feature, because most users, and particularly those having no prior knowledge of the security features of a therewith secured document or item, will only then actually perform a security check based on said security feature if they have actual knowledge of their existence and nature.

A particularly striking optical effect can be achieved if a security feature changes its appearance in view to a change in viewing conditions, such as the viewing angle. Such an effect can e,g. by obtained by dynamic appearance-changing optical devices (DACODs), such as concave, respectively convex Fresnel type reflecting surfaces relying on oriented pigment particles in a hardened coating layer, as disclosed in EP 1 710 756 A1. This document describes one way to obtain a printed image that contains pigment particles or flakes having magnetic properties by aligning the pigment particles in a magnetic field. The pigment particles or flakes, after their alignment in a magnetic field, show a Fresnel structure arrangement, such as a Fresnel reflector. By tilting the image and thereby changing the direction of reflection towards a viewer, the area showing the greatest reflection to the viewer moves according to the alignment of the flakes or pigment particles.

While the Fresnel type reflecting surfaces are flat, they provide the appearance of a concave or convex reflecting hemisphere. Said Fresnel type reflecting surfaces can be produced by exposing a wet coating layer comprising non-isotropically reflecting magnetic or magnetizable pigment particles to the magnetic field of a single dipole magnet, wherein the latter is disposed above, respectively below the plane of the coating layer, as illustrated in FIG. 7B of EP 1 710 756 A1 for a convex orientation. The so-oriented pigment particles are consequently fixed in position and orientation by hardening the coating layer.

One example of such a structure is the so-called "rolling bar" effect (FIG. 1), as disclosed in US 2005/0106367. A "rolling bar" effect is based on pigment particles orientation imitating a curved surface across the coating. The observer sees a specular reflection zone which moves away or towards the observer as the image is tilted. A so-called positive rolling bar comprises pigment particles oriented in a concave fashion (FIG. 2*b*) and follows a positively curved surface; a positive rolling bar moves with the rotation sense of tilting. A so-called negative rolling bar comprises pigment particles oriented in a convex fashion (FIG. 2*a*) and follows a negatively curved surface; a negative rolling bar moves against the rotation sense of tilting. A hardened coating comprising pigment particles having an orientation following a concave curvature (positive curve orientation) shows a visual effect characterized by an upward movement of the rolling bar (positive rolling bar) when the support is tilted backwards. The concave curvature refers to the curvature as seen by an observer viewing the hardened coating from the side of the support carrying the hardened coating. A hardened coating comprising pigment particles having an orientation following a convex curvature (negative curve orientation) shows a visual effect characterized by a downward movement of the rolling bar (negative rolling bar) when the support carrying the hardened coating is tilted backwards (i.e. the top of the support moves away from the observer while the bottom of the support moves towards from the observer). This effect is nowadays utilized for a number of security elements on banknotes, such as on the "5" of the 5 Euro banknote or the "100" of the 100 Rand banknote of South Africa.

For optical effect layers printed on a substrate, negative rolling bar effect (orientation of the pigment particles (P) in a convex fashion, curve (V), FIG. 2*a*) are produced by exposing a wet coating layer to the magnetic field of a magnet disposed on the opposite side of the substrate to the coating layer (FIG. 3*a*), while positive rolling bar effect (orientation of the pigment particles (P) in a concave fashion, curve (W), FIG. 2*b*) are produced by exposing a wet coating layer to the magnetic field of a magnet disposed on the same side of the substrate as the coating layer (FIG. 3*b*). For positive rolling bar, the position of the magnet facing the still wet coating layer may lead to some problems in industrial processes. If the magnet enters in physical contact with the wet coating layer, it may disturb the optical effect layer.

Therefore, a need remains for a method to produce security features displaying a positive rolling bar while avoiding the drawbacks of the prior art.

SUMMARY OF THE INVENTION

Accordingly, it is an object of the present invention to overcome the deficiencies of the prior art as discussed above. This is achieved by the provision of magnetic-field-generating devices which produce or form positively curved magnetic field lines (concave fashion). The present invention provides such magnetic-field-generating devices and their use for producing optical effect layers which exhibit positive rolling bar effect as an improved process, e.g. in the field of document security. The magnetic-field-generating devices of the present invention are suitable to produce positive rolling bar effects while being applied on the side of the substrate opposite to the not yet hardened coating layer comprising the non-spherical magnetic or magnetizable pigment particles.

In a first aspect of the present invention, there is provided a magnetic-field-generating device for producing an optical effect layer (DEL) made of a hardened coating, said magnetic-field-generating device being configured for receiving a supporting surface carrying a coating composition comprising a plurality of non-spherical magnetic or magnetizable pigment particles and a binder material, and being configured for orienting at least a part of the plurality of non-spherical magnetic or magnetizable pigment particles in an orientation forming a positive rolling bar effect, wherein the magnetic-field generating device is located on the side of the supporting surface opposite to the side carrying the coating composition.

In a second aspect of the present invention, there is provided a process for producing an optical effect layer (DEL) comprising the steps of a) applying on a supporting surface a coating composition comprising a binder and a plurality of non-spherical magnetic or magnetizable pigment particles, said coating composition being in a first state, b) exposing the coating composition in a first state to the magnetic field of a magnetic-field-generating device receiving the supporting surface, preferably one as defined in any of claims 1 to 9, thereby orienting at least a part of the non-spherical magnetic or magnetizable pigment particles so as to form a positive rolling bar effect, and c) hardening the coating composition to a second state so as to fix the non-spherical magnetic or magnetizable pigment particles in their adopted positions and orientations.

The present invention also encompasses an optical effect layer produced by the processes described herein and a security document comprising such an optical effect layer.

BRIEF DESCRIPTION OF DRAWINGS

The magnetic-field-generating devices according to the present invention and the process for the production of optical effect layer (OEL) exhibiting a positive rolling bar effect with these magnetic-field-generating devices are now described in more detail with reference to the drawings and to particular embodiments, wherein FIG. 1 schematically illustrates a "Rolling Bar" Effect (Prior Art).

DETAILED DESCRIPTION

Definitions

Figure 1:
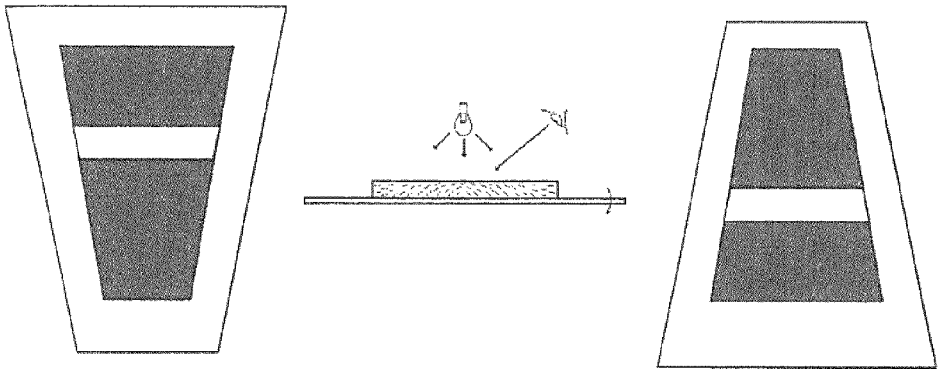

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. Preferably, the term "substantially parallel" refers to not deviating more than 10° from parallel alignment and the term "substantially perpendicular" refers to not deviating more than 10° from perpendicular alignment.

The term "at least partially" is intended to denote that the following property is fulfilled to a certain extent or completely. Preferably, the term denotes that the following property is fulfilled to at least 50% or more, more preferably at least 75%, even more preferably at least 90%. It may be preferable that the term denotes "completely".

The terms "substantially" and "essentially" are used to denote that the following feature, property or parameter is either completely (entirely) realized or satisfied or to a major degree that does adversely affect the intended result. Thus, depending on the circumstances, the term "substantially" or "essentially" preferably means e.g. at least 80%, at least 90%, at least 95%, or 100%.

The term "comprising" as used herein is intended to be non-exclusive and open-ended. Thus, for instance a coating composition comprising a compound A may include other compounds besides A. However, the term "comprising" also covers the more restrictive meanings of "consisting essentially of" and "consisting of", so that for instance "a coating composition comprising a compound A" may also (essentially) consist of the compound A.

The term "coating composition" refers to any composition which is capable of forming an optical effect layer (OEL) as used herein on a solid substrate and which can be applied preferentially but not exclusively by a printing method. The coating composition comprises at least a plurality of non-spherical magnetic or magnetizable pigment particles and a binder. Due to their non-spherical shape, the pigment particles have non-isotropic reflectivity.

The term "optical effect layer (OEL)" as used herein denotes a layer that comprises at least a plurality of oriented non-spherical magnetic or magnetizable pigment particles and a binder, wherein the non-random orientation of the non-spherical magnetic or magnetizable pigment particles is fixed within the binder.

As used herein, the term "optical effect coated substrate (OEC)" is used to denote the product resulting from the provision of the OEL on a substrate. The OEC may consist of the substrate and the OEL, but may also comprise other materials and/or layers other than the OEL. The term OEC thus also covers security documents, such as banknotes.

The term "rolling bar" or "rolling bar effect" denotes an area within the OEL that provides the optical effect or optical impression of a cylindrical bar shape lying crosswise within the OEL, with the axis of the cylindrical bar lying parallel to the plane of the OEL and the part of the curved surface of the cylindrical bar being above the plane of the OEL. The "rolling bar", i.e. the cylindrical bar shape, can be symmetrical or non-symmetrical, i.e. the radius of the cylindrical bar may be constant or not constant; when the radius of the cylindrical bar is not constant, the rolling bar has a conical form.

Figure 2A:
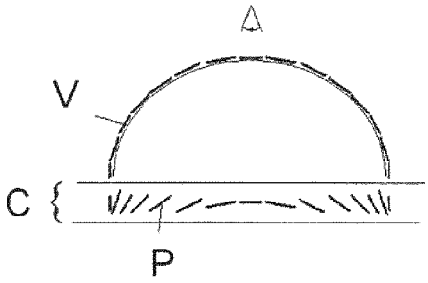
FIG. 2*a* schematically illustrates pigment particles following the tangent to a negatively curved magnetic field line in a convex fashion.
Figure 2B:
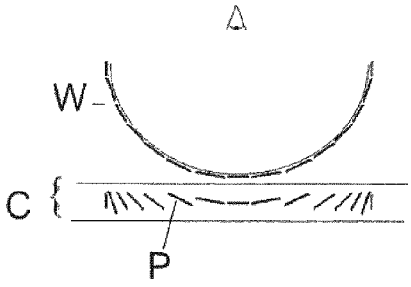
FIG. 2*b* schematically illustrates pigment particles following the tangent to a positively curved magnetic field line in a concave fashion.
Figure 3A:
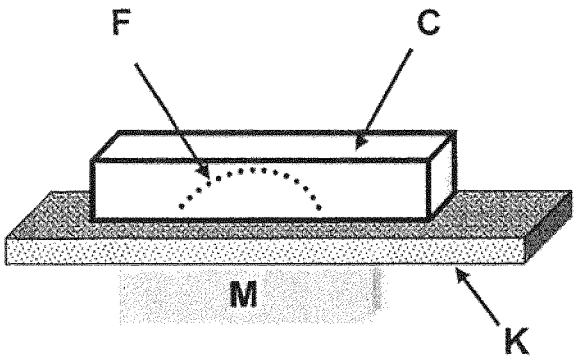
FIG. 3*a* schematically illustrates a magnetic-field generating device suitable for forming a negatively curved magnetic field line in a convex fashion according to the Prior Art.
Figure 3B:
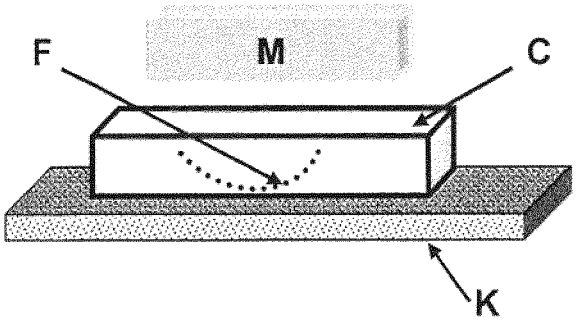
FIG. 3*b* schematically illustrates a magnetic-field generating device suitable for forming a positively curved magnetic field line in a concave fashion according to the Prior Art.

The terms "convex fashion" or "convex curvature" and the terms "concave fashion" or "concave curvature" refer to the curvature of the Fresnel surface across the OEL that provides the optical effect or the optical impression of a rolling bar. A Fresnel surface is a surface comprising microstructures in the form of a series of grooves with changing slope angles. At the position where the OEL is produced, the magnetic-field-generating device orients the non-spherical magnetic or magnetizable pigment particles following the tangent to the curved surface. The terms "convex fashion" or "convex curvature" and the terms "concave fashion" or "concave curvature" refer to the apparent curvature of the curved surface as seen by an observer viewing the optical effect layer OEL from the side of the optical effect coated substrate (OEC) carrying the OEL. The curvature of the curved surface follows the magnetic field lines produced by the magnetic field-generating device at the position where the OEL is produced. A "convex curvature" refers to a negatively curved magnetic field line (as shown in FIG. 2*a*); a "concave curvature" refers to a positively curved magnetic field line (as shown in FIG. 2*b*).

The term "security element" is used to denote an image or graphic element that can be used for authentication purposes. The security element can be an overt and/or a covert security element.

The term "magnetic axis" or "North-South axis" denotes a theoretical line connecting and extending through the North pole and South pole of a magnet. The line does not have a certain direction. Conversely, the term "North-South direction" denotes the direction along the North-South axis or magnetic axis from the North pole to the South pole.

DETAILED DESCRIPTION OF THE INVENTION

The present invention provides magnetic-field-generating devices for producing optical effect layers which exhibit a positive rolling bar effect, said magnetic-field-generating devices being advantageously applied on the side of the supporting surface opposite to the side configured for receiving the coating composition or the substrate carrying the coating composition.

"Rolling bar" effects are based on a specific orientation of magnetic or magnetizable pigment particles in a coating on a substrate. Magnetic or magnetizable pigment particles in a binder material are aligned in an arching pattern relative to a surface of the substrate so as to create a contrasting bar across the image said contrasting bar appearing to move as the image is tilted relative to a viewing angle. In particular, the magnetic-field-generating devices described herein produce optical effect layers (OEL) comprising magnetic or magnetizable pigment particles which are aligned in a curving fashion following a concave curvature (W) as shown in FIG. 2*b*, (also referred in the art as positive curve orientation). A hardened coating comprising pigment particles having an orientation following a concave curvature (positive curve orientation) shows a visual effect characterized by a movement of the rolling bar following the sense of tilting.

In one aspect, the present invention relates to magnetic-field-generating devices for producing optical effect layers (OEL) exhibiting a positive rolling bar effect, said devices comprising two or more bar dipole magnets (M1, M2, etc.), optionally one or more pole pieces (Y1, Y2, etc.), optionally a magnetic plate (M6) and a supporting surface (K) disposed above the two or more bar dipole magnets, the optional one or more pole pieces and the optional magnetic plate. The supporting surface (K) is configured for receiving a coating composition comprising the non-spherical magnetic or magnetizable pigment particles described herein and the binder material described herein, whereupon said orienting of the magnetic or magnetizable pigment particles for the formation of the optical effect layer (OEL) is to be effected. The supporting surface (K) is either a substrate or a combination of a substrate and a non-magnetic plate.

In an embodiment, said magnetic field generating device comprises a pair of spaced apart bar dipole magnets and a third magnetic or magnetizable element, preferably a third dipole magnet or a pole piece, wherein the dipole magnets have north to south axes that are aligned with each other, that are substantially parallel to the supporting surface and that have a same magnetic North-South direction, wherein the dipole magnets are spaced apart along the north south axes so as to provide a gap region between the dipole magnets in which magnetic field lines are such that the magnetic or magnetizable pigment particles are oriented in line with the field lines in the gap region to form the positive rolling bar effect, and wherein the third element is arranged with the pair of spaced dipole bar magnets to appropriately disturb the magnetic field in the gap region between the spaced apart bar dipole magnets to allow the magnetic or magnetizable particle in the coating composition to be oriented to exhibit the positive rolling bar effect. In an embodiment, the third element is arranged in the gap region between the supporting surface and the pair of dipole magnets, is arranged in the gap region between the pair of dipole magnets and aligned therewith or is arranged in the gap region, with the pair of dipole magnets disposed between the supporting surface and the third element.

In an embodiment, the third element is the third dipole magnet, and the third dipole magnet has a north south axis aligned with the north south axes of the pair of spaced apart bar dipole magnets and has a same magnetic North-South direction.

In an embodiment, the pair of spaced apart bar dipole magnets each have a pole facing the gap region, wherein the facing poles are spaced apart to form the gap region. In an embodiment, the facing poles are each positioned adjacent respective opposed polar sides of the third dipole magnet.

In an embodiment, a pair of bar dipole magnets are disposed at a periphery or outside of a periphery of the coating composition and are configured to produce magnetic field lines in a gap region between the bar dipole magnets to create the positive rolling bar effect in the coating composition in the gap region.

In an embodiment, at least one of the pair of bar dipole magnets has a length along the north to south axis that is smaller than a space between the pair of bar dipole magnets along the north to south axis.

Figure 4:
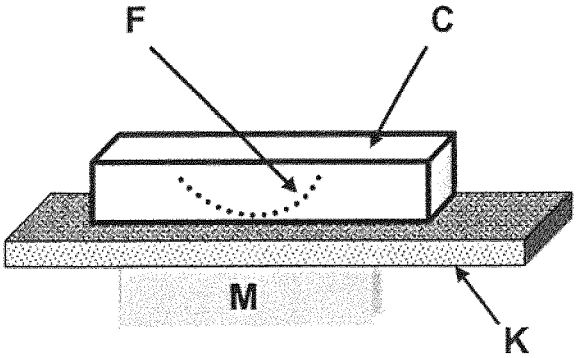
FIG. 4 schematically illustrates a magnetic-field generating device suitable for forming a positively curved magnetic field line in a concave fashion according to the present invention.

As illustrated for example in FIG. 4, the magnetic-field-generating device (M) is disposed below the supporting surface (K) and is configured such as to form concave magnetic field lines (F).

Figure 5A:
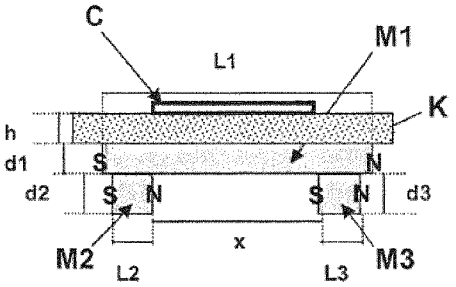
FIG. 5*a-c* schematically illustrate a magnetic-field-generating device according to a first exemplary embodiment.
Figure 5B:
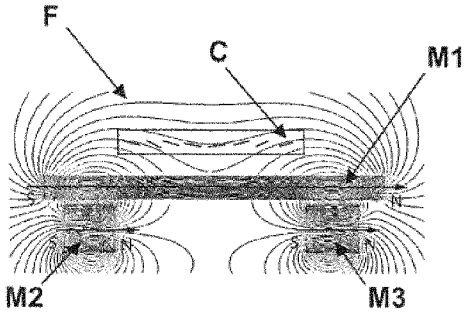
Figure 5C:
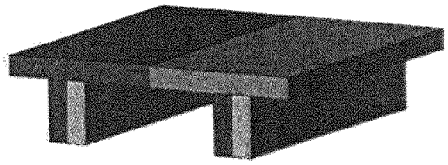

According to one embodiment of the present invention and as shown in FIGS. 5*a-c,* the magnetic-field-generating device comprise three bar dipole magnets (M1), (M2) and (M3) having their North-South axis substantially parallel to the supporting surface (K) and having the same magnetic North-South direction. The bar dipole magnet (M1) is disposed below the supporting surface (K) and above the pair of bar dipole magnets (M2) and (M3). The bar dipole magnets (M2) and (M3) are directly adjacent to the bar dipole magnet (M1) or spaced apart from the bar dipole magnet (M1). When the bar dipole magnets (M1), (M2) and (M3) are spaced apart, the distance between (M1) and the bar dipole magnets (M2) and (M3) is smaller or equal to the thickness (d1) of (M1). Preferably the bar dipole magnets (M2) and (M3) are directly adjacent to the bar dipole magnet (M1). Preferably, the bar dipole magnet (M1) has a length (L1) comprised in a range from about 10 mm to about 100 mm, more preferably from about 20 mm to about 40 mm, and a thickness (d1) in a range from about 1 mm to about 5 mm, more preferably from about 2 mm to about 4 mm; the bar dipole magnets (M2) and (M3) have a length (L2), respectively (L3), independently comprised in a range from about 1 mm to about 10 mm, a thickness (d2), respectively (d3), independently comprised in a range from about 1 mm to about 10 mm, more preferably from about 4 mm to about 6 mm and a distance (x) comprised in a range from about 5 mm to about 50 mm, more preferably from about 10 mm to about 30 mm, provided that the sum of (L2), (L3) and (x) is smaller than or equal to the length (L1). FIG. 5*a* schematically represents a cross-section view parallel to the magnetic axis of the bar dipole magnet (M1) of the magnetic-field-generating device of FIG. 5. FIG. 5*b* is another schematic representation of a cross-section view parallel to the magnetic axis of the bar dipole magnet (M1) of the magnetic-field-generating device of FIG. 5 showing the magnetic field lines (F) produced by the magnetic-field-generating device. As shown in FIG. 5*b*, the magnetic field lines (F) produced by the magnetic-field-generating device above the gap region comprised between the bar dipole magnets (M2) and (M3) are positively curved (concave fashion). As shown in FIGS. 5*a* and 5*b*, the coating composition (C) is applied on the supporting surface (K) in the gap region comprised between the bar dipole magnets (M2) and (M3). FIG. 5*c* is another schematic representation of the magnetic-field-generating device of FIG. 5 in which the North and South poles of the magnetic bar dipole (M1), (M2) and (M3) are represented by different colors, black for the South pole and grey for the North pole.

Figure 5D:
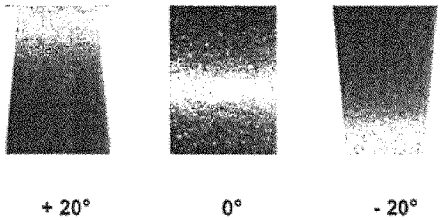
FIG. 5*d* illustrates an example of an optical effect produced by using the magnetic-field-generating device described in FIG. 5*a-c* as seen under different viewing angles.

FIG. 5*d* are pictures at three different viewing angles of a rolling bar optical effect produced by using the magnetic-field-generating device described in FIGS. 5*a-c*. A large edge denotes the side of the image which is close to the observer whereas a small edge denotes the side of the image which is away from the observer. The three pictures represent the rolling bar as seen at three different tilt angles of the OEC, or in other word at three different viewing angles relative to the surface of the OEL: the picture in the center shows the rolling bar as seen at an orthogonal viewing angle, the left and right pictures show the rolling bar as seen at a tilted viewing angle.

Figure 6A:
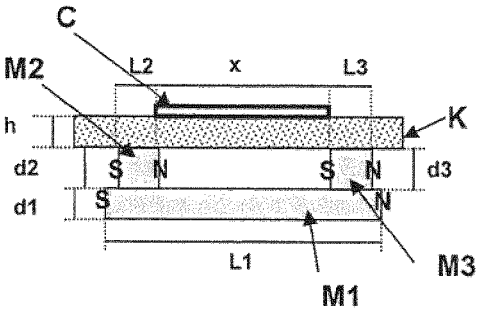
FIG. 6*a-c* schematically illustrate a magnetic-field-generating device according to a second exemplary embodiment.
Figure 6B:
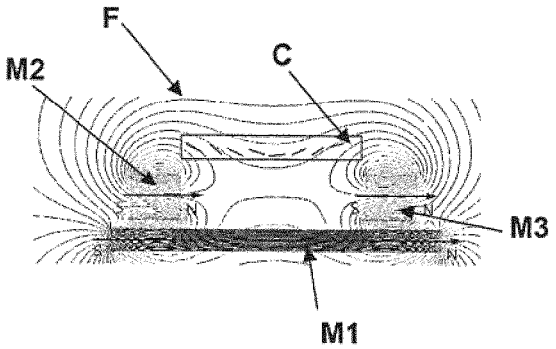
Figure 6C:
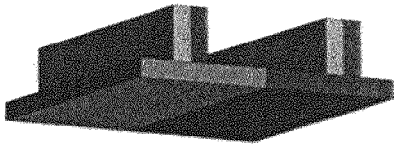
Figure 6D:
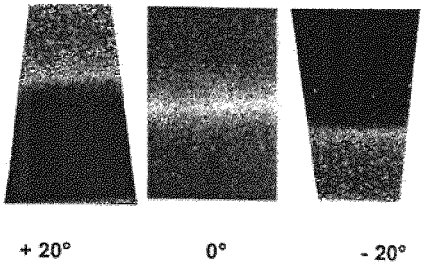
FIG. 6*d* illustrates an example of an optical effect produced by using the magnetic-field-generating device described in FIG. 6*a-c* as seen under different viewing angles.

According to another embodiment of the present invention and as shown in FIGS. 6*a-c*, the magnetic-field-generating device comprise three bar dipole magnets (M1), (M2) and (M3) having their North-South axis substantially parallel to the supporting surface (K) and having the same magnetic North-South direction. The pair of bar dipole magnets (M2) and (M3) are disposed below the supporting surface (K) and above the bar dipole magnet (M1). The bar dipole magnets (M2) and (M3) are directly adjacent to the bar dipole magnet (M1) or spaced apart from the bar dipole magnet (M1). When the bar dipole magnets (M1), (M2) and (M3) are spaced apart, the distance between (M1) and the bar dipole magnets (M2) and (M3) is smaller or equal to the thickness (d1)) of (M1). Preferably the bar dipole magnets (M2) and (M3) are directly adjacent to the bar dipole magnet (M1). Preferably, the bar dipole magnet (M1) has a length (L1) comprised in a range from about 10 mm to about 100 mm, more preferably from about 20 mm to about 40 mm, and a thickness (d1)) comprised in a range from about 1 mm to about 5 mm, more preferably from about 2 mm to about 4 mm; the bar dipole magnets (M2) and (M3) have a length (L2), respectively (L3), independently comprised in a range from about 1 mm to about 10 mm, a thickness (d2), respectively (d3), independently comprised in a range from about 1 mm to about 10 mm, more preferably from about 4 mm to about 6 mm; and a distance (x) comprised in a range from about 5 mm to about 50 mm, more preferably from about 10 mm to about 30 mm, provided that the sum of (L2), (L3) and (x) is smaller or equal to the length (L1). FIG. 6*a* schematically represents a cross-section view parallel to the magnetic axis of the bar dipole magnet (M1) of the magnetic-field-generating device of FIG. 6. FIG. 6*b* is another schematic representation of a cross-section view parallel to the magnetic axis of the bar dipole magnet (M1) of the magnetic-field-generating device of FIG. 6 showing the magnetic field lines (F) produced by the magnetic-field-generating device. As shown in FIG. 6*b*, the magnetic field lines (F) produced by the magnetic-field-generating device above the gap region comprised between the bar dipole magnets (M2) and (M3) are positively curved (concave fashion), As shown in FIGS. 6*a* and 6*b*, the coating composition (C) is applied above of the supporting surface (K) in the gap region comprised between the bar dipole magnets (M2) and (M3). FIG. 6*c* is another schematic representation of the magnetic-field-generating device of FIG. 6 in which the North and South poles of the magnetic bar dipole (M1), (M2) and (M3) are represented by different shades of grey. Similarly as in FIG. 5*d*, FIG. 6*d* are pictures at three different viewing angles of a rolling bar optical effect produced by using the magnetic-field-generating device described in FIG. 6.

In the embodiments illustrated in FIGS. 5*a-c* and in FIGS. 6*a-c*, the bar dipole magnets (M2) and (M3) may be identical or different. When the bar dipole magnets (M2) and (M3) are different from each other, either the bar dipole magnets (M2) and (M3) have different dimensions (L2) and (L3) and/or (d2) and (d3); or the bar dipole magnets (M2) and (M3) are made from different magnetic material; or the bar dipole magnets (M2) and (M3) differ by a combination of different materials and different dimensions.

The bar dipole magnets (M2) and (M3) may be made from a single bar dipole magnet. Or alternatively the bar dipole magnets (M2) and (M3) may be made of a plurality of aligned bar dipole magnets embedded in a plastic supporting scaffold and having the same magnetic North-South direction, as schematically illustrated in FIG. 10.

According to another embodiment of the present invention and as shown in FIG. 7*a-d*, the magnetic-field-generating device comprise two bar dipole magnets (M4) and (M5) having their North-South axis substantially parallel to the supporting surface (K) and having the same magnetic North-South direction, and a pole piece (Y). A pole piece denotes a structure composed of a material having high magnetic permeability, preferably a permeability between about 2 and about 1,000,000 $N \cdot A^{-2}$ (Newton per square Ampere), more preferably between about 5 and about 50,000 $N \cdot A^{-2}$ and still more preferably between about 10 and about 10,000 $N \cdot A^{-2}$. The pole piece serves to direct the magnetic field produced by a magnet. Preferably, the pole piece described herein comprises or consists of an iron yoke (Y), The pair of bar dipole magnets (M4) and (M5) are disposed below/the supporting surface (K) and the pole piece (Y) is disposed between the bar dipole magnets (M4) and (M5). The bar dipole magnets (M4) and (M5) are either adjacent to the extremities of the pole piece (Y); or alternatively the bar dipole magnets (M4) and (M5) are disposed at a distance less than 2 mm, preferably comprised in a range from about 0.1 mm to about 2 mm, from the extremities of the pole piece (Y). Preferably, the pole piece (Y) has a length (LY) comprised in a range from about 10 mm to about 50 mm, more preferably from about 15 mm to about 25 mm, and a thickness (dY) comprised in a range from about 1 mm to about 10 mm, more preferably from about 3 mm to about 6 mm. Preferably the bar dipole magnets (M4) and (M5) have a length (L4) respectively (L5) independently comprised in a range from about 1 mm to about 20 mm, more preferably form about 3 mm to 6 mm. Preferably, the bar dipole magnets (M4) and (M5) have a thickness (d4) respectively (d5) independently comprised in a range from about 1 mm to about 10 mm, more preferably from about 3 mm to about 6 mm. Preferably the thickness (dY) of the pole piece (Y) and the thickness (d4) and (d5) of the bar dipole magnets (M4) and (M5) are selected such that the thicknesses (d4) and (d5) are equal to the thickness (dY) or are up to two times the thickness (dY). The bar dipole magnets (M4) and (M5) may be identical or different. When the bar dipole magnets (M4) and (M5) are different from each other, either the bar dipole magnets (M4) and (M5) have different dimensions (L4) and (L5) and/or (d4) and (d5); or the bar dipole magnets (M4) and (M5) are made from different magnetic material; or the bar dipole magnets (M4) and (M5) differ by a combination of different materials and different dimensions. Preferably, the bar dipole magnets (M4) and (M5) are identical. When the bar dipole magnets (M4) and (M5) have a different length, it is preferred that (L4) is larger than (L5) and that (M4) has a length (L4) which is two to four times the length (L5).

Figure 7A:
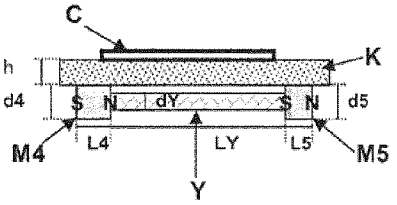
FIG. 7*a-d* schematically illustrate a magnetic-field-generating device according to a third exemplary embodiment.
Figure 7B:
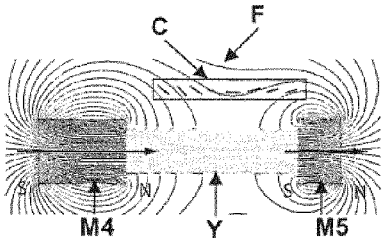
Figure 7C:
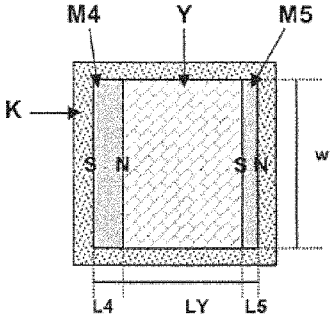
Figure 7D:
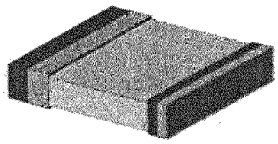

FIG. 7*a* schematically represents a cross-section view parallel to the magnetic axis of the bar dipole magnet (M4) of the magnetic-field-generating device of FIG. 7 with the pole piece (Y) disposed between the magnetic bar dipoles (M4) and (M5). FIG. 7*b* is another schematic representation of a cross-section view parallel to the magnetic axis of the bar dipole magnet (M4) of the magnetic-field-generating device of FIG. 7 showing the magnetic field lines (F) produced by the magnetic-field-generating device. As shown in FIG. 7*b*, the magnetic field lines (F) produced by the magnetic-field-generating device above the pole piece (Y) in the gap region comprised between the bar dipole magnets (M4) and (M5) are positively curved (concave fashion). As shown in FIGS. 7*a* and 7*b*, the coating composition (C) is applied on the supporting surface (K) in the region above the pole piece (Y). FIG. 7*c* schematically represents a top-view of the magnetic-field-generating device of FIG. 7. FIG. 7*d* is another schematic representation of the magnetic-field-generating device of FIG. 7 in which the North and South poles of the magnetic bar dipoles (M4) and (M5) are symbolized by different colors, black for the South pole and grey for the North pole. Similarly as in FIG. 5*d*, FIG. 7*e* are three pictures at different viewing angles of a rolling bar optical effect produced by using the magnetic-field-generating device described in FIG. 7.

Figure 8A:
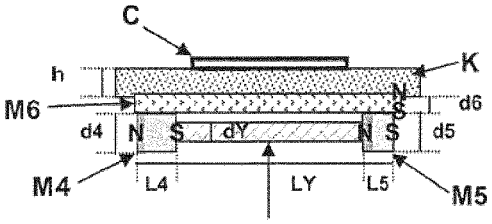
FIG. 8*a-c* schematically illustrate a magnetic-field-generating device according to a fourth exemplary embodiment.
Figure 8B:
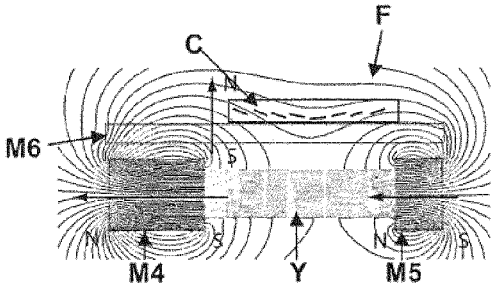
Figure 8C:
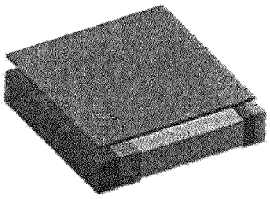

According to another embodiment described herein and illustrated in FIG. 8*a*, the magnetic-field-generating device of FIGS. 7*a-d* further comprise a non-engraved magnetic plate (M6) located between the assembly made of the two bar dipole magnets (M4) and (M5) and of the pole piece (Y), and the supporting surface (K) and having its North-South axis substantially perpendicular to the supporting surface (K).

Figure 9A:
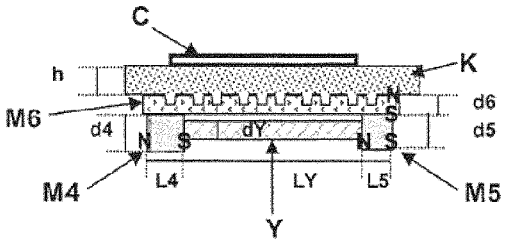
FIG. 9*a-c* schematically illustrate a magnetic-field-generating device according to a fifth exemplary embodiment.
Figure 9B:
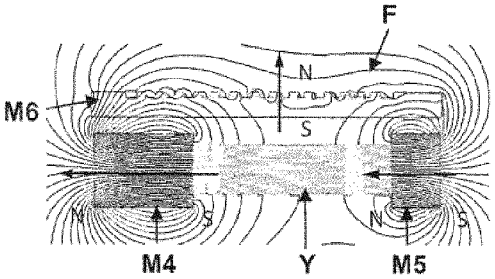
Figure 9C:
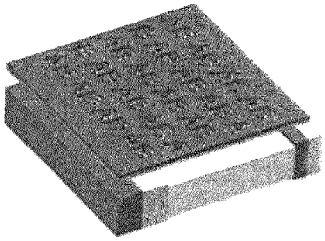

According to another embodiment described herein and illustrated in FIGS. 9*a-c*, the magnetic-field-generating device of FIGS. 7*a-d* further comprise an engraved magnetic plate (M6) located between the assembly made of the two bar dipole magnets (M4) and (M5) and of the pole piece (Y), and the supporting surface (K) and having its North-South axis substantially perpendicular to the supporting surface (K).

FIG. 9*a* schematically represents a cross-section view parallel to the magnetic axis of the bar dipole magnet (M4) of the magnetic-field-generating device of FIG. 9, comprising the magnetic bar dipoles (M4) and (M5), the pole piece (Y) and the engraved magnetic plate (M6). FIG. 9*b* is another schematic representation of a cross-section view parallel to the magnetic axis of the bar dipole magnet (M4) of the magnetic-field-generating device of FIG. 9 showing the magnetic field lines (F) produced by the magnetic-field-generating device. FIG. 9*c* is another schematic representation of the magnetic-field-generating device of FIG. 9 from a top-view with the engravings of the magnetic plate (M6) in the form of A and B indicia. Similarly as in FIG. 5*d*, FIG. 9*d* are pictures at three different viewing angles of a rolling bar optical effect produced by using the magnetic-field-generating device described in FIG. 9.

The bar dipole magnets (M1), (M2), (M3), (M4), (M5) and the magnetic plate (M6) of the magnetic-field-generating devices described herein may comprise or consist of any permanent-magnetic (hard-magnetic) material, for example of Alnico alloy, barium- or strontium-hexaferrite, cobalt alloys, or rare-earth-iron alloys such as neodymium-iron-boron alloy. For the magnetic plate (M6), particularly preferred are, however, easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

The magnetic plate (M6) may be an engraved magnetic plate (as shown in FIG. 9*a-c*) or a non-engraved magnetic plate (as shown in FIG. 8*a*). When the magnetic plate (M6) is an engraved magnetic plate, it may be produced by any method that is capable of providing the desired structure by material abrasion, such as by engraving or grinding of a permanent magnetic plate, for example by physical means, laser ablation or chemical means, or by material accretion, such as for example 3D-printing. Examples of engraved magnetic plate have been disclosed e.g. in EP 1 641 624 B1 and EP 1 937 415 B1.

The surface of the magnetic-field-generating device facing the supporting surface (K) may have any shape such as e.g. a round, oval, ellipsoid, square, triangular, rectangular or any polygonal shape.

As illustrated for example in FIGS. 5-9, typically a supporting surface (K), above which a layer (C) of the coating composition in a fluid state (prior to hardening) and comprising a plurality of non-spherical magnetic or magnetizable pigment particles (P) is provided, is positioned above the magnetic-field-generating device and is exposed to the magnetic field of the device. The supporting surface (K) is either a substrate on which the coating composition (C) is applied, or a combination of a non-magnetic plate and a substrate. When the supporting surface (K) is a combination of a non-magnetic plate and a substrate, the non-magnetic plate is formed by a thin (typically less than 0.5 mm thickness, such as 0.1 mm thickness) plate made from a non-magnetic material, such as a polymeric material or a metal plate made from a non-magnetic material, such as for example aluminum. When present, the non-magnetic plate is an intrinsic part of the magnetic device of the present invention. The coating composition (C) is applied to the supporting surface (K), followed by orientation and hardening of the coating composition, forming an OEL in the same manner as described above.

Notably, when the supporting surface (K) comprises the combination of a substrate and a non-magnetic plate, the coating composition (C) can be provided on the substrate before the substrate with the applied coating composition is placed on the non-magnetic plate, or the coating composition can be applied on the substrate at a point in time where the substrate is already placed on the non-magnetic plate.

When the supporting plate comprises a substrate (and not the combination of a substrate and a non-magnetic plate), said substrate can also take the role of a supporting surface, replacing the plate. In particular if the substrate is dimensionally stable, it may not be necessary to provide e.g. a plate for receiving the substrate, but the substrate may be provided on or above the magnet without a supporting plate interposed therebetween. In the following description, the term "supporting surface", in particular with regard to the orientation of magnets in respect thereof, may in such embodiments therefore relate to a position or plane that is taken by the substrate surface without an intermediate plate being provided.

If the supporting surface is formed by the combination of a non-magnetic plate and a substrate, said non-magnetic plate is provided above a magnet of the magnetic-field-generating device. The distance (h) between the end of the poles of the magnet and the substrate surface on the side where the coating composition (C) is applied and where the OEL is to be formed by orientation of the pigment particles is equal to the sum of the thickness of the non-magnetic plate and of the substrate. If the supporting surface is formed by a substrate, the distance (h) is equal to the thickness of the substrate. The distance (h) is typically in the range between 0.05 millimeters to about 5 millimeters, preferably between about 0.1 and about 5 millimeters, and is selected such as to produce the appropriate dynamic rolling bar element, according to the design needs. If the supporting surface is formed by the combination of a non-magnetic plate and a substrate, said non-magnetic plate may be part of a mechanically solid assembly of the magnetic field generating device.

Depending on the distance (h), dynamic rolling bar bodies having different shapes, such as e.g. different curvatures, different rolling bar widths or differently looking striking effects, may be produced with a same magnetic-field-generating device. The thickness of the substrate may contribute to the distance between the magnet and the coating composition. Yet, typically the substrate is very thin (such as about 0.1 mm in case of a paper substrate for a banknote), so that this contribution may in practice be disregarded. However, if the contribution of the substrate cannot be disregarded, e.g. in cases where the substrate thickness is greater than 0.2 mm, the thickness of the substrate may be considered to contribute to the distance (h).

After the coating composition (C) is provided on the supporting surface (K) the magnetic or magnetizable pigment particles align with the magnetic field lines (F) of the magnetic-field-generating device.

Also described herein are processes for producing the OEL described herein, said processes comprising the steps of:

a) applying on a supporting surface (K), a coating composition (C) in a first (fluid) state comprising a binder material and a plurality of non-spherical magnetic or magnetizable pigment particles (P) described herein,
b) exposing the coating composition (C) in a first state to the magnetic field of the magnetic-field-generating device described herein and disposed on the side of the supporting surface (K) or of a substrate provided on the supporting surface opposite to the side provided with the coating composition (C) so that at least a part of the coating composition is overlapping the piece pole (Y) or the section of the magnetic-field-generating device between the bar dipole magnets (M2) and (M3), thereby orienting the non-spherical magnetic or magnetizable pigment particles within the coating composition in a concave fashion; and c) hardening the coating composition to a second state so as to fix the magnetic or magnetizable non-spherical pigment particles in their adopted positions and orientations.

In the step b), preferably the coating composition (C) is applied so that it overlaps the center of the piece pole (Y) or the central section of the magnetic-field-generating device between the bar dipole magnets (M2) and (M3).

The applying step a) is preferably a printing process selected from the group consisting of copperplate intaglio printing, screen printing, gravure printing, flexography printing and roller coating and more preferably from the group consisting of screen printing, gravure printing and flexography printing. These processes are well-known to the skilled man and are described for example in Printing Technology, J. M. Adams and P. A. Dolin, Delmar Thomson Learning, $5^{th}$ Edition.

While the coating composition (C) comprising the plurality of non-spherical magnetic or magnetizable pigment particles (P) described herein is still wet or soft enough so that the non-spherical magnetic or magnetizable pigment particles therein can be moved and rotated (i.e. while the coating composition is in a first state), the coating composition is subjected to the magnetic field of the magnetic-field-generating device described herein to achieve positive curve orientation of the pigment particles following magnetic field lines curved in a concave fashion. The step of magnetically orienting the non-spherical magnetic or magnetizable pigment particles comprises a step of exposing the applied coating composition, while it is "'wet" (i.e. still liquid and not too viscous, that is, in a first state), to a determined magnetic field generated at or above a supporting surface of the magnetic-field-generating device described herein, thereby orienting the non-spherical magnetic or magnetizable pigment particles along the magnetic field lines of the magnetic field such as to form an orientation pattern in a bar-shape. As illustrated in the FIGS. 5 to 9, the magnetic-field-generating device is positioned on the opposite side of the supporting surface (K) to the side provided with the coating composition (C). As illustrated in the FIGS. 5 to 9, the coating composition is applied so that it is positioned above the cross-section of the magnetic-field-generating device parallel to the bar dipole magnets. The magnetic-field-generating device produces magnetic field lines curved in a concave fashion resulting in a positive curve orientation of the non-spherical magnetic or magnetizable pigment particles, in this step, the coating composition is brought sufficiently close to or in contact with the supporting surface of the magnetic-field-generating device.

Following or simultaneously with the application of the coating composition on the supporting surface of magnetic-field-generating device, the non-spherical magnetic or magnetizable pigment particles are oriented by the use of the external magnetic-field-generating device for orienting them according to a desired orientation pattern. Thereby, a permanent magnetic pigment particle is oriented such that its magnetic axis is aligned with the direction of the external magnetic field line at the pigment particle's location. A magnetizable pigment particle without an intrinsic permanent magnetic field is oriented by the external magnetic field such that the direction of its longest dimension is aligned with a magnetic field line at the pigment particle's location. The above applies analogously in the event that the pigment particles should have a layer structure including a layer having magnetic or magnetizable properties. In this case, the longest axis of the magnetic layer or the longest axis of the magnetizable layer is aligned with the direction of the magnetic field.

Subsequently or simultaneously with the step of orienting/aligning the pigment particles by applying a magnetic field, the orientation of the pigment particles is fixed. The coating composition must thus noteworthy have a first state, i.e. a liquid or pasty state, wherein the coating composition is wet or soft enough, so that the non-spherical magnetic or magnetizable pigment particles dispersed in the coating composition are freely movable, rotatable and/or orientable upon exposure to a magnetic field, and a second hardened (e.g. solid) state, wherein the non-spherical pigment particles are fixed or frozen in their respective positions and orientations.

Such a first and second state is preferably provided by using a certain type of coating composition. For example, the components of the coating composition other than the non-spherical magnetic or magnetizable pigment particles may take the form of an ink or coating composition such as those which are used in security applications, e.g. for banknote printing.

The aforementioned first and second state can be provided by using a material that shows a great increase in viscosity in reaction to a stimulus such as for example a temperature change or an exposure to an electromagnetic radiation. That is, when the fluid binder material is hardened or solidified, said binder material converts into the second state, i.e. a hardened or solid state, where the pigment particles are fixed in their current positions and orientations and can no longer move nor rotate within the binder material.

As known to those skilled in the art, ingredients comprised in an ink or coating composition to be applied onto a surface such as a substrate and the physical properties of said ink or coating composition are determined by the nature of the process used to transfer the ink or coating composition to the surface. Consequently, the binder material comprised in the ink or coating composition described herein is typically chosen among those known in the art and depends on the coating or printing process used to apply the ink or coating composition and the chosen hardening process.

In one embodiment, a polymeric thermoplastic binder material or a thermoset may be employed. Unlike thermosets, thermoplastic resins can be repeatedly melted and solidified by heating and cooling without incurring any important changes in properties. Typical examples of thermoplastic resin or polymer include without limitation polyamides, polyesters, polyacetals, polyolefins, styrenic polymers, polycarbonates, polyarylates, polyimides, polyether ether ketones (PEEK), polyetherketeoneketones (PEKK), polyphenylene based resins (e.g. polyphenylenethers, polyphenylene oxides, polyphenylene sulfides), polysulphones and mixtures of these.

If desired, a primer layer may be applied to the substrate prior to the step a). This may enhance the quality of the optical effect layer or promote adhesion. Examples of such primer layers may be found in WO 20101058026 A2.

The step of exposing the coating composition comprising the binder material and the plurality of non-spherical magnetic or magnetizable pigment particles to a magnetic field (step b) can be performed either simultaneously with the step a) or subsequently to the step a). That is, steps a) and b) may be performed simultaneously or subsequently.

The processes for producing the DEL described herein comprise, concomitantly to step b) or subsequently to step b), a step of hardening (step c) the coating composition so as to fix the non-spherical magnetic or magnetizable pigment particles in their adopted positions and orientations, thereby transforming the coating composition to a second state. By this fixing, a solid coating or layer is formed. The term "hardening" refers to processes including the drying or solidifying, reacting, curing, cross-linking or polymerizing the binder components in the applied coating composition, including an optionally present cross-linking agent, an optionally present polymerization initiator, and optionally present further additives, in such a manner that an essentially solid material that strongly adheres to the substrate surface is formed. As mentioned hereabove, the hardening step (step c) may be performed by using different means or processes depending on the binder material comprised in the coating composition that also comprises the plurality of non-spherical magnetic or magnetizable pigment particles.

The hardening step generally may be any step that increases the viscosity of the coating composition such that a substantially solid material adhering to the supporting surface is formed. The hardening step may involve a physical process based on the evaporation of a volatile component, such as a solvent, and/or water evaporation (i.e. physical drying). Herein, hot air, infrared or a combination of hot air and infrared may be used. Alternatively, the hardening process may include a chemical reaction, which is not reversed by a simple temperature increase (e.g. up to 80° C.) that may occur during a typical use of a security document, said chemical reaction may be a curing, polymerizing or cross-linking of the binder and optional initiator compounds and/or optional cross-linking compounds comprised in the coating composition. The term "curing" or "curable" refers to processes including the chemical reaction, crosslinking or polymerization of at least one component in the applied coating composition in such a manner that it turns into a polymeric material having a greater molecular weight than the starting substances. Preferably, the curing causes the formation of a three-dimensional polymeric network. Such a curing is generally induced by applying an external stimulus to the coating composition (i) after its application on a substrate surface or a supporting surface of a magnetic-field-generating device and (ii) subsequently or simultaneously with the orientation of the non-spherical magnetic or magnetizable pigment particles. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis light curing) and electronic beam radiation curing (E-beam curing); oxypolymerization (oxidative reticulation, typically induced by a joint action of oxygen and one or more catalysts, such as cobalt-containing and manganese-containing catalysts); cross-linking reactions or any combination thereof. Therefore, preferably the coating composition is an ink or coating composition selected from the group consisting of radiation curable compositions, thermal drying compositions, oxidatively drying compositions, and combinations thereof. Particularly preferably, the coating composition is an ink or coating composition selected from the group consisting of radiation curable compositions.

Radiation curing is particularly preferred, and UV-Vis light radiation curing is even more preferred, since these technologies advantageously lead to very fast curing processes and hence drastically decrease the preparation time of any article comprising the OEL described herein. Moreover, radiation curing has the advantage of producing an instantaneous increase in viscosity of the coating composition after exposure to the curing radiation, thus minimizing any further movement of the pigment particles. In consequence, any loss of information after the magnetic orientation step can essentially be avoided. Particularly preferred is radiation-curing by photo-polymerization, under the influence of actinic light having a wavelength component in the UV or blue part of the electromagnetic spectrum (typically 300 nm to 550 nm; more preferably 380 nm to 420 nm; "UV-visible-curing"). Equipment for UV-visible-curing may comprise a high-power light-emitting-diode (LED) lamp, or an arc discharge lamp, such as a medium-pressure mercury arc (MPMA) or a metal-vapor arc lamp, as the source of the actinic radiation. The hardening step (step c) can be performed either simultaneously with the step b) or subsequently to the step b). However, the time from the end of step b) to the beginning of step c) is preferably relatively short in order to avoid any de-orientation and loss of information. Typically, the time between the end of step b) and the beginning of step c) is less than 1 minute, preferably less than 20 seconds, further preferably less than 5 seconds, even more preferably less than 1 second. It is particularly preferable that there is essentially no time gap between the end of the orientation step b) and the beginning of the hardening step c), i.e. that step c) follows immediately after step b) or already starts while step b) is still in progress, Preferable radiation curable compositions include compositions that may be cured by UV-visible light radiation (hereafter referred as UV-Vis-curable) or by E-beam radiation (hereafter referred as EB). Radiation curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. Preferably, the UV-Vis-curable composition comprises one or more compounds selected from the group consisting of radically curable compounds, cationically curable compounds and mixtures thereof. Cationically curable compounds are cured by cationic mechanisms typically including the activation by radiation of one or more photoinitiators which liberate cationic species, such as acids, which in turn initiate the curing so as to react and/or cross-link the monomers and/or oligomers to thereby harden the coating composition. Radically curable compounds are cured by free radical mechanisms typically including the activation by radiation of one or more photoinitiators, thereby generating radicals which in turn initiate the polymerization so as to harden the coating composition.

As outlined above, step a) (application on the supporting surface (K) can be performed either simultaneously with the step b) or previously to the step b) (orientation of pigment particles by a magnetic field), and also step c) (hardening) can be performed either simultaneously with the step b) or subsequently to the step b) (orientation of pigment particles by a magnetic field). While this may also be possible for certain types of equipment, typically not all three steps a), b) and c) are performed simultaneously. Also, steps a) and b), and steps b) and c) may be performed such that they are partly performed simultaneously (i.e. the times of performing each of the steps partly overlap, so that e.g. the hardening step c) is started at the end of the orientation step b).

After application of the coating composition on a substrate and orientation of the non-spherical magnetic or magnetizable pigment particles, the coating composition is hardened (i.e. turned to a solid or solid-like state) in order to fix the orientation of the pigment particles.

The magnetic-field-generating devices and the process recited in the present invention are used to produce optical effect layer (OEL) exhibiting positive rolling bar effect.

The OEL comprises a plurality of non-spherical magnetic or magnetizable pigment particles that, due to their non-spherical shape, have a non-isotropic reflectivity. The non-spherical magnetic or magnetizable pigment particles are dispersed in a binder material and have a specific orientation for providing the optical effect. The orientation is achieved by orienting the non-spherical magnetic or magnetizable pigment particles in accordance with the external magnetic field produced by the magnetic-field-generating device described herein.

Because the non-spherical magnetic or magnetizable pigment particles within the coating composition, which is in a fluid state and wherein the pigment particles are rotatable/orientable prior to the hardening of the coating composition, align themselves along the field lines as described hereabove, the achieved respective orientation of the pigment particles (i.e. their magnetic axis in the case of magnetic particles or their greatest dimension in the case of magnetizable pigment particles) coincides, at least on average, with the local direction of the magnetic field lines at the positions of the pigment particles.

In the OEL, the non-spherical magnetic or magnetizable pigment particles are dispersed in a coating composition comprising a hardened binder material that fixes the orientation of the non-spherical magnetic or magnetizable pigment particles. The hardened binder material is at least partially transparent to electromagnetic radiation of one or more wavelengths in the range of 200 nm to 2500 nm. Preferably, the hardened binder material is at least partially transparent to electromagnetic radiation of one or more wavelengths in the range of 200-800 nm, more preferably in the range of 400-700 nm. Incident electromagnetic radiation, e,g. visible light, entering the OEL through its surface can reach the pigment particles dispersed within the OEL and be reflected there, and the reflected light can leave the OEL again for producing the desired optical effect. Herein, the term "one or more wavelengths" denotes that the binder material may be transparent to only one wavelength in a given wavelength range, or may be transparent to several wavelengths in a given range. Preferably, the binder material is transparent to more than one wavelength in the given range, and more preferably to all wavelengths in the given range. Thus, in a more preferred embodiment, the hardened binder material is at least partly transparent to all wavelengths in the range of about 200-about 2500 nm (or 200-800 nm, or 400-700 nm), and even more preferably the hardened binder material is fully transparent to all wavelengths in these ranges.

Herein, the term "transparent" denotes that the transmission of electromagnetic radiation through a layer of 20 μm of the hardened binder material as present in the OEL (not including the non-spherical magnetic or magnetizable pigment particles, but all other optional components of the OEL in case such components are present) is at least 80%, more preferably at least 90%, even more preferably at least 95%. This can be determined for example by measuring the transmittance of a test piece of the hardened binder material (not including the non-spherical magnetic or magnetizable pigment particles) in accordance with well-established test methods, e.g. DIN 5036-3 (1979-11).

If the wavelength of incident radiation is selected outside the visible range, e.g. in the near UV-range, then the OEL may also serve as a covert security feature, as then typically technical means will be necessary to detect the (complete) optical effect generated by the OEL under respective illuminating conditions comprising the selected non-visible wavelength. In this case, it is preferable that the OEL comprises luminescent pigment particles that show luminescence in response to the selected wavelength outside the visible spectrum contained in the incident radiation. The infrared, visible and UV portions of the electromagnetic spectrum approximately correspond to the wavelength ranges between 700-2500 nm, 400-700 nm, and 200-400 nm respectively.

The non-spherical magnetic or magnetizable pigment particles described herein have, due to their non-spherical shape, non-isotropic reflectivity with respect to an incident electromagnetic radiation for which the hardened binder material is at least partially transparent. As used herein, the term "non-isotropic reflectivity" denotes that the proportion of incident radiation from a first angle that is reflected by a pigment particle into a certain (viewing) direction (a second angle) is a function of the orientation of the pigment particles, i.e. that a change of the orientation of the pigment particle with respect to the first angle can lead to a different magnitude of the reflection to the viewing direction.

Preferably, each of the plurality of non-spherical magnetic or magnetizable pigment particles described herein have a non-isotropic reflectivity with respect to incident electromagnetic radiation in some parts or in the complete wavelength range between about 200 and about 2500 nm, more preferably between about 400 and about 700 nm, such that a change of the pigment particle's orientation results in a change of reflection by that pigment particle into a certain direction.

In the OEL described herein, the non-spherical magnetic or magnetizable pigment particles are provided in such a manner as to form a dynamic positive rolling bar security element.

Herein, the term "dynamic" denotes that the appearance and the light reflection of the security element changes depending on the viewing angle. Put differently, the appearance of the security element is different when viewed from different angles, i.e. the security element exhibits a different appearance (e.g. when viewed from a viewing angle of about 90° as compared to a viewing angle of about 22.5°, both with respect to the plane of the OEL). This behavior is caused by the orientation of the non-spherical magnetic or magnetizable pigment particles having non-isotropic reflectivity.

Optically variable elements are known in the field of security printing. Optically variable elements (also referred in the art as colorshifting or goniochromatic elements) exhibit a viewing-angle or incidence-angle dependent color, and are used to protect banknote and other security documents against counterfeiting and/or illegal reproduction by commonly available color scanning, printing and copying office equipment.

The plurality of non-spherical magnetic or magnetizable pigment particles may comprise non-spherical optically variable magnetic or magnetizable pigment particles and/or non-spherical magnetic or magnetizable pigment particles having no optically variable properties.

Preferably, at least a part of the plurality of non-spherical magnetic or magnetizable pigment particles described herein is constituted by non-spherical optically variable magnetic or magnetizable pigment particles. Preferably the non-spherical magnetic or magnetizable pigment particles are prolate or oblate ellipsoid-shaped, platelet-shaped or needle-shaped pigment particles or mixtures thereof. Thus, even if the intrinsic reflectivity per unit surface area (e.g. per $\mu m^2$) is uniform across the whole surface of such pigment particle, due to its non-spherical shape, the reflectivity of the pigment particle is non-isotropic as the visible area of the pigment particle depends on the direction from which it is viewed. In one embodiment, the non-spherical magnetic or magnetizable pigment particles having non-isotropic reflectivity due to their non-spherical shape may further have an intrinsic non-isotropic reflectivity, such as for instance in optically variable magnetic pigment particles, due to the presence of layers of different reflectivity and refractive indexes. In this embodiment, the non-spherical magnetic or magnetizable pigment particles comprise non-spherical magnetic or magnetizable pigment particles having intrinsic non-isotropic reflectivity, such as non-spherical optically variable magnetic or magnetizable pigment particles.

Preferably at least a part of the plurality of non-spherical magnetic or magnetizable pigment particles is selected from the group consisting of magnetic thin-film interference pigment particles, magnetic interference coated pigment particles, magnetic cholesteric liquid crystal pigment particles and mixtures thereof.

Suitable examples of non-spherical magnetic or magnetizable pigment particles described herein include without limitation pigment particles comprising a ferromagnetic or a ferrimagnetic metal such as cobalt, iron, or nickel; a ferromagnetic or ferrimagnetic alloy of iron, manganese, cobalt, iron or nickel; a ferromagnetic or ferrimagnetic oxide of chromium, manganese, cobalt, iron, nickel or mixtures thereof; as well as the mixtures thereof. Ferromagnetic or ferrimagnetic oxides of chromium, manganese, cobalt, iron, nickel or mixtures thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M stands for a two-valent and R for a three-valent, and A for a four-valent metal ion, and "magnetic" for ferro- or ferrimagnetic properties.

As mentioned above, preferably at least a part of the plurality of non-spherical magnetic or magnetizable pigment particles is constituted by non-spherical optically variable magnetic or magnetizable pigment particles. These can more preferably be selected from the group consisting of magnetic thin-film interference pigment particles, magnetic cholesteric liquid crystal pigment particles and mixtures thereof.

Magnetic thin film interference pigment particles are known to those skilled in the art and are disclosed e.g. in U.S. Pat. No. 4,838,648; WO 2002/073250 A2; EP 686 675 A1; WO 2003/000801 A2; U.S. Pat. No. 6,838,166; WO 2007/131833 A1 and in the thereto related documents. Due to their magnetic characteristics, they are machine readable, and therefore coating compositions comprising magnetic thin film interference pigment particles may be detected for example with specific magnetic detectors. Therefore, coating compositions comprising magnetic thin film interference pigment particles may be used as a covert or semi-covert security element (authentication tool) for security documents.

Preferably, the magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure. Preferred five-layer Fabry-Perot multilayer structures consist of absorber/dielectric/reflector/dielectric/absorber multilayer structures wherein the reflector and/or the absorber is also a magnetic layer. Preferred six-layer Fabry-Perot multilayer structures consist of absorber/dielectric/reflector/magnetic/dielectric/absorber multilayer structures. Preferred seven-layer Fabry Perot multilayer structures consist of absorber/dielectric/reflector/magnetic/reflector/dielectric/absorber multilayer structures such as disclosed in U.S. Pat. No. 4,838,648; and more preferably seven-layer Fabry-Perot absorber/dielectric/reflector/magnetic/reflector/dielectric/absorber multilayer structures. Preferably, the reflector layers described herein are selected from the group consisting of metals, metal alloys and combinations thereof, preferably selected from the group consisting of reflective metals, reflective metal alloys and combinations thereof, and more preferably from the group consisting of aluminum (Al), chromium (Cr), nickel (Ni), and mixtures thereof and still more preferably aluminum (Al). Preferably, the dielectric layers are independently selected from the group consisting of magnesium fluoride ($Mg F_2$), silicium dioxide ($SiO_2$) and mixtures thereof, and more preferably magnesium fluoride ($MgF_2$). Preferably, the absorber layers are independently selected from the group consisting of chromium (Cr), nickel (Ni), metallic alloys and mixtures thereof. Preferably, the magnetic layer is preferably selected from the group consisting of nickel (Ni), iron (Fe) and cobalt (Co), alloys comprising nickel (Ni), iron (Fe) and/or cobalt (Co), and mixtures thereof. It is particularly preferred that the magnetic thin film interference pigment particles comprise a seven-layer Fabry-Perot absorber/dielectric/reflector/magnetic/reflector/dielectric absorber multilayer structure consisting of a $Cr/MgF_2/Al/Ni/Al/MgF_2/Cr$ multilayer structure.

Magnetic thin film interference pigment particles described herein are typically manufactured by vacuum deposition of the different required layers onto a web. After deposition of the desired number of layers, e.g. by PVD, the stack of layers is removed from the web, either by dissolving a release layer in a suitable solvent, or by stripping the material from the web. The so-obtained material is then broken down to flakes which have to be further processed by grinding, milling or any suitable method. The resulting product consists of flat flakes with broken edges, irregular shapes and different aspect ratios. Further information on the preparation of suitable magnetic thin film interference pigment particles can be found e.g. in EP-A 1 710 756, which is hereby incorporated by reference.

Suitable interference coated pigments including one or more magnetic materials include without limitation structures consisting of a substrate selected from the group consisting of a core coated with one or more layers, wherein at least one of the core or the one or more layers have magnetic properties. For example, suitable interference coated pigments comprise a core made of a magnetic material such as those described hereabove, said core being coated with one or more layers made of metal oxides as well as structure consisting of a core made of synthetic or natural micas, layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures thereof.

Suitable magnetic cholesteric liquid crystal pigment particles exhibiting optically variable characteristics include without limitation monolayered cholesteric liquid crystal pigment particles and multilayered cholesteric liquid crystal pigment particles. Such pigment particles are disclosed for example in WO 2006/063926 A1, U.S. Pat. Nos. 6,582,781 and 6,531,221. WO 2006/063926 A1 discloses monolayers and pigment particles obtained therefrom with high brilliance and colorshifting properties with additional particular properties such as magnetizability. The disclosed monolayers and pigment particles, which are obtained therefrom by comminuting said monolayers, comprise a three-dimensionally crosslinked cholesteric liquid crystal mixture and magnetic nanoparticles. U.S. Pat. Nos. 6,582,781 and 6,410,130 disclose platelet-shaped cholesteric multilayer pigment particles which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigment particles which comprise the sequence A/B and if desired C, wherein A and C are absorbing layers comprising pigment particles imparting magnetic properties, and B is a cholesteric layer.

In addition to the non-spherical magnetic or magnetizable pigment particles (which may or may not comprise or consist of non-spherical optically variable magnetic or magnetizable pigment particles), also non-magnetic or non-magnetizable pigment particles may be contained in the positive rolling bar security element. These pigment particles may be color pigment particles known in the art, having or not having optically variable properties. Further, the pigment particles may be spherical or non-spherical and may have isotropic or non-isotropic optical reflectivity.

In the OEL, the non-spherical magnetic or magnetizable pigment particles described herein are dispersed in a binder material. Preferably, the non-spherical magnetic or magnetizable pigment particles are present in an amount from about 5 to about 40 weight percent, more preferably about 10 to about 30 weight percent, the weight percentages being based on the total dry weight of the OEL, comprising the binder material, the non-spherical magnetic or magnetizable pigment particles and other optional components of the OEL.

The total number of non-spherical magnetic or magnetizable pigment particles in the OEL may be appropriately chosen in function of the desired application; however, to make up a surface-covering pattern generating a visible effect, several thousands of pigment particles, such as about 1,000-10,000 pigment particles, are generally required in a volume corresponding to one square millimeter of OEL surface.

In addition to the overt security provided by the colorshifting property of the non-spherical optically variable magnetic or magnetizable pigment particles, which allows easily detecting, recognizing and/or discriminating the OEL or the OEC (such as a security document) carrying the OEL described herein from their possible counterfeits with the unaided human senses, e.g. because such features may be visible and/or detectable while still being difficult to produce and/or to copy, the colorshifting property of the non-spherical optically variable magnetic or magnetizable pigment particles may be used as a machine readable tool for the recognition of the OEL. Thus, the optically variable properties of the non-spherical optically variable magnetic or magnetizable pigment particles may simultaneously be used as a covert or semi-covert security feature in an authentication process wherein the optical (e.g. spectral) properties of the pigment particles are analyzed.

The use of non-spherical optically variable magnetic or magnetizable pigment particles enhances the significance of the OEL as a security feature in security document applications, because such materials (i.e. optically variable magnetic or magnetizable pigment particles) are reserved to the security document printing industry and are not commercially available to the public.

The plurality of non-spherical magnetic or magnetizable pigment particles, which together produce the optical effect of the security element disclosed herein, may correspond to all or only to a subset of the total number of pigment particles in the OEL. For example, the pigment particles producing the optical effect of a bar-shaped body may be combined with other pigment particles contained in the binder material, which may be conventional or special color pigment particles.

The coating composition may further comprise one or more machine readable materials selected from the group consisting of magnetic materials, luminescent materials, electrically conductive materials, infrared-absorbing materials and mixtures thereof. As used herein, the term "machine readable material" refers to a material which exhibits at least one distinctive property which is not perceptible by the naked eye, and which can be comprised in a layer so as to confer a way to authenticate said layer or article comprising said layer by the use of a particular equipment for its authentication.

The coating composition may further comprise one or more coloring components selected from the group consisting of organic and inorganic pigments and organic dyes, and/or one or more additives. The latter include without limitation compounds and materials that are used for adjusting physical, rheological and chemical parameters of the coating composition such as the viscosity (e.g. solvents, thickeners and surfactants), the consistency (e.g. anti-settling agents, fillers and plasticizers), the foaming properties (e.g. antifoaming agents), the lubricating properties (waxes, oils), UV stability (photosensitizers and photostabilizers), the adhesion properties, the antistatic properties, the storage stability (polymerization inhibitors) etc. Additives described herein may be present in the coating composition in amounts and in forms known in the art, including in the form of so-called nano-materials where at least one of the dimensions of the additive is in the range of 1 to 1000 nm.

Also described herein are rotating printing assemblies comprising one or more magnetic-field-generating devices for producing the OEL described herein, said magnetic-field-generating devices being fitted and/or inserted on the printing cylinder as a part of the rotating printing machine. In such a case, the one or more magnetic-field-generating devices are correspondingly designed and adapted to the cylindrical surface of the rotating unit in order to assure a smooth contact with the surface to be imprinted.

With the aim of increasing the durability through soiling or chemical resistance and cleanliness and thus the circulation lifetime of security documents, or with the aim of modifying their aesthetical appearance (e.g. optical gloss), one or more protective layers may be applied on top of OEL. When present, the one or more protective layers are typically made of protective varnishes. These may be transparent or slightly colored or tinted and may be more or less glossy. Protective varnishes may be radiation curable compositions, thermal drying compositions or any combination thereof. Preferably, the one or more protective layers are radiation curable compositions, more preferable UV-Vis curable compositions. The protective layers may be applied after the formation of the OEL in step c).

In the processes described above the OEL may be provided directly on a substrate on which it shall remain permanently (such as for banknote applications). Alternatively, the OEL may also be provided on a temporary substrate for production purposes, from which the OEL is subsequently removed. This may for example facilitate the production of the OEL, particularly while the binder material is still in its fluid state. Thereafter, after hardening the coating composition for the production of the OEL, the temporary substrate may be removed from the OEL. Of course, in such cases the coating composition must be in a form that is physically integral after the hardening step, such as for instances in cases where a plastic-like or sheet-like material is formed by the hardening. Thereby, a film-like transparent and/or translucent material consisting of the OEL as such (i.e. essentially consisting of oriented magnetic or magnetizable pigment particles having non-isotropic reflectivity, hardened binder components for fixing the pigment particles in their orientation and forming a film-like material, such as a plastic film, and further optional components) can be provided.

The process described above may further comprise a step of adding an adhesive layer on the side opposite the side where the OEL is provided, or an adhesive layer provided on the same side as the OEL and on top of the OEL, preferably after the hardening step has been completed. In such instances, an adhesive label comprising the adhesive layer and the OEL is formed. Such a label may be attached to all kinds of documents or other articles or items without printing or other processes involving machinery and rather high effort, Alternatively, the OEC is manufactured in the form of a transfer foil, which can be applied to a document or to an article in a separate transfer step. To this aim, the substrate is provided with a release coating, on which an OEL is produced as described herein. One or more adhesive layers may be applied over the so produced OEL.

The substrate described herein is preferably selected from the group consisting of papers or other fibrous materials, such as cellulose, paper-containing materials, glasses, ceramics, plastics and polymers, glasses, metals, composite materials and mixtures or combinations thereof. Typical paper, paper-like or other fibrous materials are made from a variety of fibers including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins such as polyethylene (PE) and polypropylene (PP), polyamides, polyesters such as poly(ethylene terephthalate) (PET), poly(1,4-butylene terephthalate) (PBT), poly(ethylene 2,6-naphthoate) (PEN) and polyvinylchlorides (PVC). Spunbond olefin fibers such as those sold under the trademark Tyvek® may also be used as substrate. Metals include without limitation those used for the preparation of metal coins and those used for the preparation of metalized plastic polymer materials such as metalized security threads. Typical examples of composite materials include without limitation multilayer structures or laminates of paper and at least one plastic or polymer material such as those described hereabove as well as plastic and/or polymer fibers incorporated in a paper-like or fibrous material such as those described hereabove. Of course, the substrate can comprise further additives that are known to the skilled person, such as sizing agents, whiteners, processing aids, reinforcing or wet strengthening agents etc.

With the aim of further increasing the security level and the resistance against counterfeiting and illegal reproduction of security documents, the process described herein may further comprise a step of adding to the OEC printed, coated, or laser-marked or laser-perforated indicia, watermarks, security threads, fibers, planchettes, luminescent compounds, windows, foils, decals and combinations thereof. With the same aim of further increasing the security level and the resistance against counterfeiting and illegal reproduction of security documents, the process described herein may further comprise a step of adding to the OEC one or more marker substances or taggants and/or machine readable substances (e.g. luminescent substances, UV/visible/IR absorbing substances, magnetic substances and combinations thereof).

The OEL produced by the process described herein may be used for decorative purposes as well as for protecting and authenticating a security document. Described herein are also articles and decorative objects comprising the OEL described herein. The articles and decorative object may comprise more than one optical effect layers described herein. Typical examples of articles and decorative objects include without limitation luxury goods, cosmetic packagings, automotive parts, electronic/electrical appliances, furnitures, etc.

Also described herein are security documents comprising the OEL produced with the magnetic-field-generating device and the process described herein. The security document may comprise more than one optical effect layers described herein. Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles and the like. The term "value commercial good" refers to packaging materials, in particular for pharmaceutical, cosmetics, electronics or food industry, that shall be protected against counterfeiting and/or illegal reproduction in order to warrant the content of the packaging like for instance genuine drugs. Examples of these packaging materials include without limitation labels, such as authentication brand labels, tamper evidence labels and seals.

Preferably, the security document described herein is selected from the group consisting of banknotes, identity documents, right-conferring documents, driving licenses, credit cards, access cards, transportation titles, bank checks and secured product labels. Alternatively, the OEL may be produced onto an auxiliary substrate such as for example a security thread, security stripe, a foil, a decal, a window or a label and consequently transferred to a security document in a separate step.

The skilled person can envisage several modifications to the specific embodiments described above without departing from the spirit of the present invention. Such modifications are encompasses by the present invention.

Further, all documents referred to throughout this specification are hereby incorporated by reference in their entirety as set forth in full herein.

The present invention will now be described by way of Examples, which are however not intended to limit its scope in any way.

EXAMPLES

Magnetic-field-generating devices according to FIGS. 5 to 9 were used to orient non-spherical optically variable magnetic pigment particles in a printed layer of the UV-curable screen printing ink described in Table 1 on a black paper as the substrate. The paper substrate carrying an applied layer of the UV-curable screen printing ink described in Table 1 was disposed on a supporting surface (K) made of polyethylene. The so-obtained magnetic orientation pattern of the optically variable pigment particles was, subsequently to the applications step, fixed by UV-curing the printed layer comprising the pigment particles.

TABLE 1

| The ink had the following formula: | |
|---|---|
| Epoxyacrylate oligomer | 40% |
| Trimethylolpropane triacrylate monomer | 10% |
| Tripropyleneglycol diacrylate monomer | 10% |
| Genorad 16 (Rahn) | 1% |
| Aerosil 200 (Evonik) | 1% |
| Irgacure 500 (BASF) | 6% |
| Genocure EPD (Rahn) | 2% |
| Non-spherical optically variable magnetic pigment particles (7 layers)(*) | 20% |
| Dowanol PMA | 10% |

(*)green-to-blue optically variable magnetic pigment particles having a flake shape of diameter d50 about 20 μm and thickness about 1 μm, obtained from JDS-Uniphase, Santa Rosa, CA.

Example 1

The magnetic-field-generating device comprised a bar dipole magnet (M1) being disposed above bar dipole magnet dipole magnets (as illustrated by (M2) and (M3) in FIG. 5*a*). The bar dipole magnet M1 had a length (L1) of 30 mm and 2 mm for (L2) and (L3) for the bar dipole magnets (M2) and (M3). The thickness (d1) was 2 mm and (d2), (d3) 5 mm. The distance (x) between magnets (M2) and (M3) was 24 mm. The magnetic-field-generating device had a width (w) of 30 mm, i.e. the bar dipole magnet (M1) and the bar dipole magnets (M2 and M3) had each a width of 30 mm. The bar dipole magnets consisted of NdFeB UH30 for (M1) and NdFeB N48 for M(2) and M(3) magnets. The distance h was 2 mm. Pictures of the resulting optical effect layer are shown in FIG. 5*d*.

Example 2

The magnetic-field-generating device comprised a bar dipole magnet (M1) being disposed below bar dipole magnet dipole magnets (as illustrated by (M2) and (M3) in FIG. 6*a*). The bar dipole magnet M1 had a length (L1) of 30 mm and 2 mm for (L2) and (L3) for the bar dipole magnets (M2) and (M3). The thickness (d1) was 5 mm and (d2), (d3) 5 mm. The distance (x) between magnets (M2) and (M3) was 18 mm. The magnetic-field-generating device had a width (w) of 30 mm, i.e. the bar dipole magnet (M1) and the bar dipole magnets (M2 and M3) had each a width of 30 mm. The bar dipole magnets consisted of NdFeB N42 for (M1) and NdFeB N48 for M(2) and M(3) magnets. The distance h was 2 mm. Pictures of the resulting optical effect layer are shown in FIG. 6*d*.

Example 3

Symetric Device

Figure 7E:
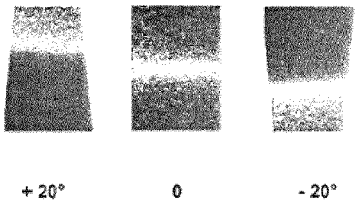
FIG. 7*e* illustrates an example of an optical effect produced by using the magnetic-field-generating device described in FIG. 7*a-d* as seen under different viewing angles.

A magnetic-field-generating device comprised a pole piece (Y) being disposed between a pair of bar dipole magnets (as illustrated by (M4) and (M5) in FIG. 7*a*). The pole piece (Y) had a length (LY) of 21 mm and a thickness (dY) of 5 mm. The bar dipole magnets (M4 and M5) had a length (L4) and (L5) of 4 mm, and a thickness (d4) and (d5) of 5 mm. The magnetic-field-generating device had a width (w) of 30 mm, i.e. the pole piece (Y) and the bar dipole magnets (M4 and M5) had each a width of 30 mm. The pole piece (Y) consisted of pure iron ARMCO® and the pair of bar dipole magnets consisted of NdFeB N48 magnets. The distance h was 3 mm. Pictures of the resulting optical effect layer are shown in FIG. 7*e*.

Example 4

Asymetric Device

Figure 8D:
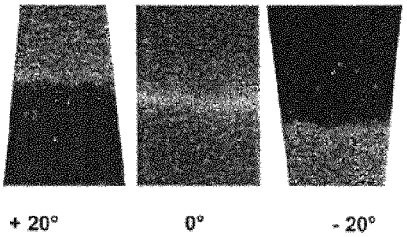
FIG. 8*d* illustrates an example of an optical effect produced by using the magnetic-field-generating device described in FIG. 8*a-c* as seen under different viewing angles.

A magnetic-field-generating device comprised a pole piece (Y) being disposed between a pair of bar dipole magnets (as illustrated by (M4) and (M5) in FIG. 8*a*). The pole piece (Y) had a length (LY) of 21 mm and a thickness (dY) of 5 mm. The bar dipole magnet (M4) had a length (L4) of 6 mm and the bar dipole magnet (M5) has a length (L5) of 3 mm. The bar dipole magnets (M4 and M5) had a thicknesses (d4) and (d5) of 6 mm. The magnetic plate (M6) was disposed at a 3 mm distance from the pole piece (Y). The magnetic-field-generating device had a width (w) of 30 mm, i.e. the pole piece (Y) and the bar dipole magnets had each a width of 30 mm. The pole piece (Y) consisted of pure iron ARMCO® and the pair of bar dipole magnets consisted of NdFeB N48 magnets. The magnetic plate (M6) was a plastic bonded magnet (strontium-hexaferrite-loaded plastoferrite) with a thickness of a 1 mm. The distance h was 3 mm. Pictures of the resulting optical effect layer are shown in FIG. 8*d*.

Example 5

Figure 9D:
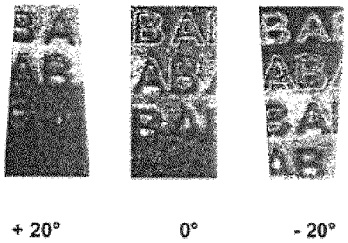
FIG. 9*d* illustrates an example of an optical effect produced by using the magnetic-field-generating device described in FIG. 9*a-c* as seen under different viewing angles.

A magnetic-field-generating device comprised a pole piece (Y) being disposed between a pair of bar dipole magnets (as illustrated by (M4) and (M5) in FIG. 9*a*). The pole piece (Y) had a length (LY) of 21 mm and a thickness (dY) of 5 mm. The bar dipole magnet (M4) had a length (L4) of 6 mm and the bar dipole magnet (M5) had a length (L5) of 3 mm. The bar dipole magnets (M4 and M5) had a thicknesses (d4) and (d5) of 6 mm. The magnetic plate (M6) with engravings in the form of A and B indicia was disposed at a 3 mm distance from the pole piece (Y). The magnetic-field-generating device had a width (w) of 30 mm, i.e. the pole piece (Y) and the bar dipole magnets had each a width of 30 mm. The pole piece (Y) consisted of pure iron ARMCO® and the pair of bar dipole magnets (M4 and M5) consisted of NdFeB N35 magnets. The magnetic plate (M6) was a plastic bonded magnet (strontium-hexaferrite-loaded plastoferrite) with a thickness of a 1 mm and a gravure depth of the A and B indicia of 0.4 mm. The distance h was 3 mm. Pictures of the resulting optical effect layer are shown in FIG. 9*d*.

The invention claimed is:

1. A process for producing an optical effect layer (OEL) comprising:

a) applying on a supporting surface a coating composition comprising a binder and a plurality of non-spherical magnetic or magnetizable pigment particles, said coating composition being in a first state, b) exposing the coating composition in a first state to the magnetic field of a magnetic-field-generating device receiving the supporting surface, thereby orienting at least a part of the non-spherical magnetic or magnetizable pigment particles so as to form a positive rolling bar effect, the magnetic-field generating device is located on the side of the supporting surface opposite to the side carrying the coating composition, and c) hardening the coating composition to a second state so as to fix the non-spherical magnetic or magnetizable pigment particles in their adopted positions and orientations, wherein said magnetic-field-generating device is configured for receiving the supporting surface carrying the coating composition, and is configured for forming concave magnetic field lines for orienting at least the part of the plurality of non-spherical magnetic or magnetizable pigment particles in an orientation forming the positive rolling bar effect, and wherein said magnetic-field-generating device is:

a) a bar dipole magnet (M1) and a pair of bar dipole magnets (M2) and (M3), said bar dipole magnets (M1), (M2) and (M3) having their North-South axis substantially parallel to the supporting surface and the same magnetic North-South direction, a1) said bar dipole magnet (M1) is disposed below the supporting surface and said pair of bar dipole magnets (M2) and (M3) are disposed below the bar dipole magnet (M1) apart from each other; or a2) said pair of bar dipole magnets (M2) and (M3) are disposed below the supporting surface and apart from each other, and said bar dipole magnet (M1) is disposed below said pair of bar dipole magnets (M2) and (M3); or b) a pair of bar dipole magnets (M4) and (M5) and a pole piece (Y), said pair of bar dipole magnets (M4) and (M5) having their North-South axis substantially parallel to the supporting surface and the same magnetic North-South direction, said pole piece (Y) being disposed between said bar dipole magnet (M4) and said bar dipole magnet (M5); or c) a pair of bar dipole magnets (M4) and (M5), a pole piece (Y) and a magnetic plate (M6), said pair of bar dipole magnets (M4) and (M5) having their North-South axis substantially parallel to the supporting surface and the same magnetic North-South direction, said magnetic plate (M6) having its North-South axis substantially perpendicular to the supporting surface, said pole piece (Y) being disposed between said bar dipole magnet (M4) and said bar dipole magnet (M5); or d) wherein said magnetic field generating device comprises a pair of spaced apart bar dipole magnets and a third element, preferably a third dipole magnet or a pole piece, wherein the dipole magnets have north to south axes that are aligned with each other, that are substantially parallel to the supporting surface and that have a same magnetic North-South direction, wherein the dipole magnets are spaced apart along the north south axes so as to provide a gap region between the dipole magnets in which magnetic field lines are such that the magnetic or magnetizable pigment particles are oriented in the gap region to form the positive rolling bar effect and wherein the third element is arranged with the pair of spaced dipole bar magnets to disturb the magnetic field in the gap region between the spaced apart bar dipole magnets.

2. The process of claim 1, wherein the supporting surface is a substrate on which the coating composition (C) is applied, or a combination of a non-magnetic plate and a substrate.

3. The process of claim 1, wherein said magnetic-field-generating device is the pair of bar dipole magnets (M4) and (M5), the pole piece (Y) and the magnetic plate (M6), wherein the magnetic plate (M6) surface facing the supporting surface comprises engravings.

4. The process of claim 1, wherein said magnetic field generating device comprises the pair of spaced apart bar dipole magnets and the third element, wherein the third element is the third dipole magnet, and the third dipole magnet has a north south axis aligned with the north south axes of the pair of spaced apart bar dipole magnets and has a same magnetic North-South direction; and the pair of spaced apart bar dipole magnets each have a pole facing the gap region, wherein the facing poles are spaced apart to form the gap region and are positioned adjacent to the opposed polar sides of the third dipole magnet.

5. The process of claim 1, wherein the pair of bar dipole magnets are disposed at a periphery or outside of a periphery of the coating composition and are configured to produce magnetic field lines in a gap region between the bar dipole magnets to create the positive rolling bar effect in the coating composition in the gap region.

6. The process of claim 1, wherein at least one of the pair of bar dipole magnets has a length along the north to south axis that is smaller than a space between the pair of bar dipole magnets along the north to south axis.

7. The process of claim 1, comprising applying the optical effect layer to a security document.

8. The process of claim 7, wherein the security document is selected from the group consisting of banknotes, identity documents, right-conferring documents, driving licenses, credit cards, access cards, transportation titles, bank checks and secured product labels.

* * * * *